US006257912B1

(12) United States Patent
Boillot et al.

(10) Patent No.: US 6,257,912 B1
(45) Date of Patent: Jul. 10, 2001

(54) DEVICE FOR CONNECTING A COAXIAL CABLE TO A PRINTED CIRCUIT CARD

(75) Inventors: Laurent Boillot, Voiron; Olivier Gonzales, Saint Nicolasde Macherin, both of (FR)

(73) Assignee: Radiall

( * ) Notice: Subject to any disclaimer, the term of this patent is extended or adjusted under 35 U.S.C. 154(b) by 0 days.

(21) Appl. No.: 09/450,975

(22) Filed: Nov. 30, 1999

(30) Foreign Application Priority Data

Nov. 30, 1998 (FR) ..... 98 15039

(51) Int. Cl.[7] ..... H01R 13/62; H01R 9/05; H01R 12/00

(52) U.S. Cl. ..... 439/329; 439/578; 439/63

(58) Field of Search ..... 439/63, 581, 329, 439/357, 67, 582, 578, 579

(56) References Cited

U.S. PATENT DOCUMENTS

| | | | | |
|---|---|---|---|---|
| 3,910,665 | | 10/1975 | Stull . | |
| 4,707,040 | * | 11/1987 | Hansel, III | 439/510 |
| 4,772,222 | * | 9/1988 | Laudig et al. | 439/578 |
| 5,263,877 | * | 11/1993 | Mitani | 439/585 |
| 5,482,475 | | 1/1996 | Kawaguchi . | |
| 5,700,152 | * | 12/1997 | Niedzwiecki | 439/78 |
| 6,053,743 | * | 4/2000 | Mitchell et al. | 439/63 |

FOREIGN PATENT DOCUMENTS

| | | |
|---|---|---|
| 44 10 072 | 9/1994 | (DE) . |
| 2 748 862 | 11/1997 | (FR) . |
| 2 254 495 | 10/1992 | (GB) . |

* cited by examiner

*Primary Examiner*—Gary F. Paumen
*Assistant Examiner*—Edwin A. León
(74) *Attorney, Agent, or Firm*—Schweitzer Cornman Gross & Bondell LLP

(57) ABSTRACT

A device for connecting a coaxial cable to a printed circuit card comprises:

a socket suitable for being fixed to the card; and a plug suitable for being mounted on the end of the coaxial cable and having a bearing face whereby said plug can press against the printed circuit card. The socket and the plug are organized so that the plug can be inserted into the socket and can be retained by the socket with the plug's bearing face pressed against the printed circuit card. The central contact of the plug has a rigid portion which projects from the bearing face of said plug, and the device includes resilient means urging the plug towards the printed circuit card.

16 Claims, 9 Drawing Sheets

DEVICE FOR CONNECTING A COAXIAL CABLE TO A PRINTED CIRCUIT CARD

The present invention relates to a device for connecting a coaxial cable to a printed circuit card.

BACKGROUND OF THE INVENTION

Devices for connecting coaxial cables to printed circuit cards are known to be of the type comprising a socket which is fixed to the printed circuit card by soldering or as a force-fit in holes provided for this purpose in the card, and a plug which is designed to be mounted on the end of the coaxial cable and which is inserted in the socket.

Known devices of that type are generally complex in structure.

In addition, when mechanical forces are imposed on the coaxial cable, the plug is subjected to stresses and possibly also to small displacements which spoil its conditions of electrical contact with the printed circuit card and can give rise to the coaxial connection being interrupted.

OBJECTS AND SUMMARY OF THE INVENTION

The present invention seeks to resolve those drawbacks by proposing a device that is reliable and durable.

The present invention provides a device for connecting a coaxial cable to a printed circuit card, the device comprising:

a socket suitable for being fixed to the card;

a plug suitable for being mounted at the end of the coaxial cable, and comprising a central contact designed to be connected to the central conductor of the cable, and a bearing face via which said plug can press against the printed circuit card;

the socket and the plug being organized so that the plug can be inserted into the socket and can be retained by the socket with the bearing face of the plug pressed against the printed circuit card, the central contact of the plug thus being electrically connected to a conductor track of the printed circuit card;

wherein:

the central contact of the plug has a rigid protuberance projecting from the bearing face of said plug; and the device includes resilient means urging the plug towards the printed circuit card.

It will be understood that by means of its rigid protuberance projecting from the bearing face, the central contact is in direct contact with the desired track of the printed circuit card.

Thus, the force with which the plug bears against the printed circuit card, which force is the result of drive from the resilient means, serves to ensure that the electrical connection between the central contact of the plug and the printed circuit card is good.

In a particular embodiment, the plug has a ground contact designed to be connected to the outer conductor of the cable.

The term "ground contact" is used herein to designate a specific piece or a specific portion of the body of the plug, whose presence is justified solely by this ground contact function, independently of any ability of the plug body for making an electrical connection between the outer conductor of the cable and the ground tracks of the printed circuit card.

In a particular variant of the invention, the ground contact of the plug can likewise include a protuberance projecting from the bearing face of the plug.

In which case, the force exerted by the resilient means on the plug to push it against the printed circuit card serves to ensure contact both of the central contact and of the ground contact on the corresponding tracks of the printed circuit card.

In a preferred embodiment of the invention, the resilient means is constituted by a spring blade. The spring blade can be carried by the plug or by the socket.

In a particular embodiment of the invention, the socket has an electrically conductive body which is designed to be electrically connected to the ground tracks of the printed circuit card.

Advantageously, the plug and the socket are organized so that the outer conductor of the cable is electrically connected to the body of the socket when the plug is inserted in the socket.

To this end, the spring blade can be used as means for putting the body of the socket into electrical contact with the outer conductor of the cable, e.g. by bearing directly against the outer conductor of the cable when said spring blade is carried by the socket.

In a particular embodiment of the invention, the socket is made by cutting and folding metal sheet.

The fact that the socket is an electrically-conductive part presents the advantage that once the plug has been inserted into the socket and the socket has been connected to ground, the socket serves to shield the coaxial line by surrounding it almost completely.

When such a socket carries the spring blade, the blade can be the result of making a special cutout in the socket.

Advantageously, the central contact of the plug is constituted by a metal insert retained in an insulator secured to the body of the plug.

The body of the plug may be constituted by a block of plastics material in which a housing is provided to receive the end of a coaxial cable.

The block of plastics material may be covered in a layer of conductive material, which layer is designed to be electrically connected to the outer conductor of the cable.

Also, the body of the plug may be constituted by a metal block.

In another embodiment, the body of the plug is made by cutting, folding, and/or rolling a sheet of metal.

In this embodiment, the plug may have a portion suitable for being crimped directly onto the outer conductor of the cable.

Apart from this crimping, the electrical connections between the inner and outer conductors of the cable and the central and ground contacts of the plug can be made by any conventional means, in particular by soldering.

In another variant of this embodiment, the body of the plug has an elastically deformable bottom wall suitable for being deformed in a direction that is perpendicular to the general plane of the printed circuit card, the central contact being mounted in said bottom wall.

Thus, when the plug is inserted in the socket, the central contact is firmly pressed against the printed circuit card because of the reaction from the end wall which is deformed towards the inside of the plug.

BRIEF DESCRIPTION OF THE DRAWINGS

To make the invention better understood, there follows a description of embodiments given as non-limiting examples, and with reference to the accompanying drawings, in which.

MORE DETAILED DESCRIPTION

Figure 1:
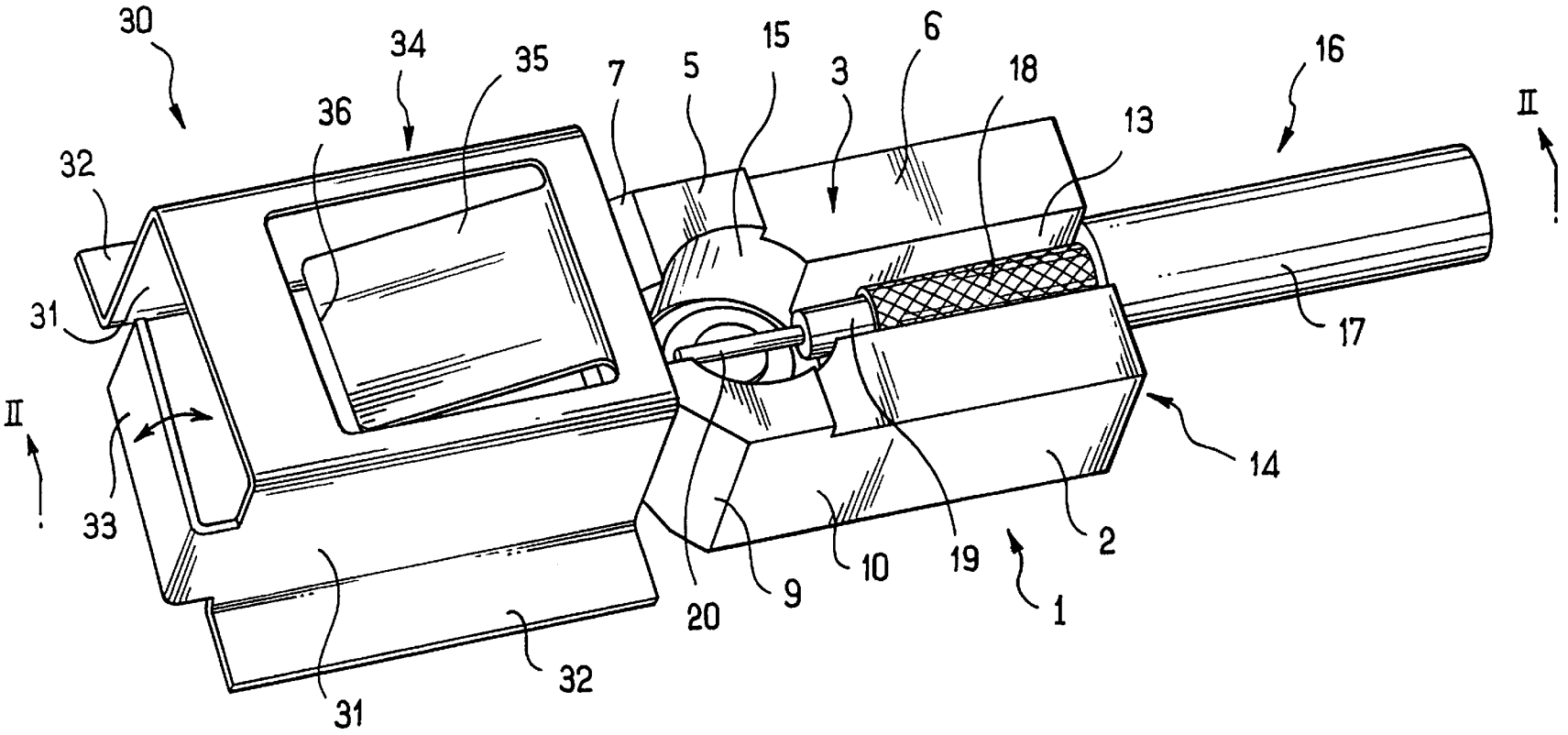
FIG. 1 is a perspective view from above of a plug and a socket constituting a first embodiment of the invention.

The plug 1 shown in FIG. 1 comprises a body constituted by a substantially parallelepipedal block 2 of brass which comprises, on its top face 3, a shoulder 4 which separates a high front surface 5 from a low rear surface 6.

The front portion of the block 2, i.e. the portion carrying its end that is to penetrate first into the socket, has a chamfer 7 connecting the high surface 5 to the front surface 8 of the block, and a chamfer 9 connecting a side face 10 of the block to its front face 8, and also a chamfer 11 connecting the bottom face 12 of the block to its front face 8.

The bottom face 12 is the face via which the plug can press against the printed circuit card. The bottom face 12 is also referred to as the "bearing" face of the plug.

An axial groove 13 is formed in the block 2 going down from its top face 3 to a depth which leaves a sufficient thickness of material to ensure that the plug remains rigid. This groove extends longitudinally from the front face 8 of the block 2 to its rear face 14 remote from the front face 8.

In its front portion, the block 2 has a chimney passing through said block from its top face 3 to its bearing face 12.

The chimney 15 intersects the groove 13.

Figure 2:
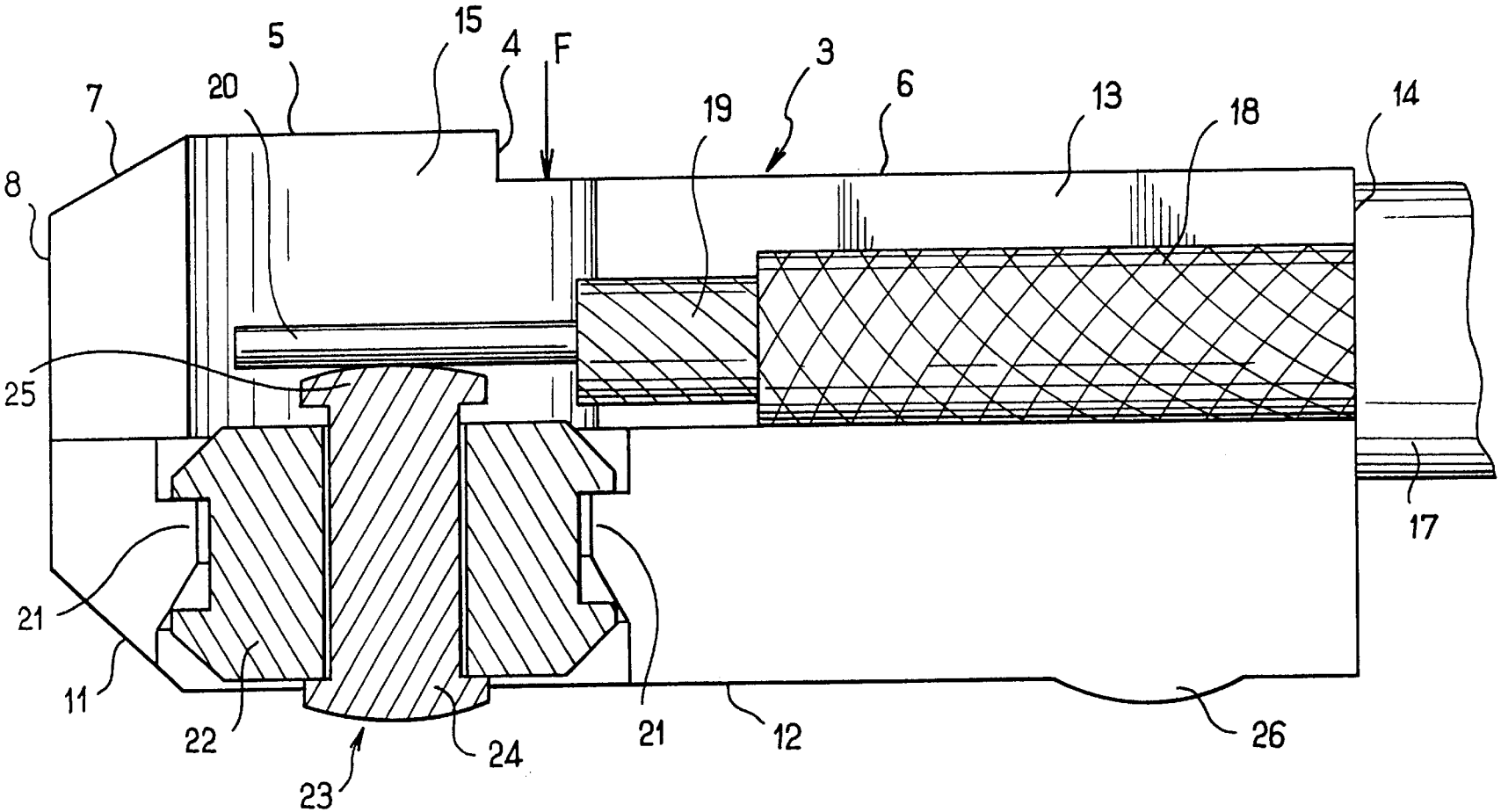
FIG. 2 is a section view through the plug of FIG. 1 on II—II.

As can be seen in FIGS. 1 and 2, the groove 13 is designed to receive the end of a coaxial cable 16 that has been stripped of its outer sheath 17.

The outer conductor 18 of the cable, also known as its ground braid, extends from the rear face 14 of the plug to the vicinity of the chimney 15. The dielectric 19 between the outer conductor 18 and the central conductor 20 extends right up to the chimney 15, and only the fully-stripped central conductor 20 penetrates into the chimney.

The bottom half of the wall of the chimney has snap-fastening shapes 21 which enable a tubular insulator 22 to be snap-fastened into the chimney via the bearing face 12 of the block, as can be seen in FIG. 2.

A stud 23 is held on the axis of the tubular insulator 22. The stud can constitute an insert which is overmolded when the tubular insulator 22 is made by molding.

The stud 23 has a rounded head 24 projecting form the tubular insulator 22 and from the bearing face 12 of the block 2. The head 24 thus acts as a protuberance in the meaning of the invention.

A head 25 having the same shape projects from the face of the tubular insulator that is remote from the bearing face 12 and serves to make contact between the stud and the central conductor of the cable.

The symmetrical shapes of the stud and of the tubular insulator about a midplane perpendicular to their axis enables said insulator to be inserted into the chimney either way up, i.e. its head 24 can be up or down, thereby facilitating operations involved in assembling the plug when such operations are performed manually.

If assembly is performed automatically, it is preferable for the insulator and/or the stud to be asymmetrical in shape so as to make them easier to grasp.

The electrical connection between the central conductor of the cable and the stud takes place by soldering to the head 25.

The ground braid of the coaxial cable is soldered to the bottom of the groove 13, thereby providing the electrical connection between the outer conductor of the cable and the body of the plug.

On its bearing face 12, the plug also has a bulge 26 which projects from the remainder of the bearing face 12 in the same manner as the head 24 of the stud 23.

The printed circuit card (not shown) has conductor tracks which are to be found in register with the stud 23 and with the bulge 26 when the plug is inserted in the socket.

In this case, the socket 30 is made by cutting out and folding sheet metal.

It is generally in the form of a rectangular parallelepiped provided along its two longitudinal faces 31 with two fixing flanges designed to be soldered to the surface of the printed circuit card.

The bottom of the socket is open, as is its short side or "end" directed towards the plug so as to enable the plug to be inserted therein.

The other end of the socket is closed by a tab 33 which is folded to extend a little towards the inside of the socket and which presents a degree of resilience.

The top wall 34 of the socket has a spring blade 35 which is directed towards the inside of the socket and which also has a degree of resilience enabling it to be retracted into the thickness of the wall 34 so as to allow the plug to be inserted in the socket.

During this insertion operation, the plug is engaged by force into the socket with the chamfers 7 and 9 serving to center the plug within the socket.

The high surface 5 pushes up the spring blade 35 until the free edge 36 of said spring blade comes level with the shoulder 4 on the plug. At which moment, the free edge 36 moves from the high surface 5 to the low surface 6 by the spring blade relaxing resiliently, while the front face 8 of the plug pushes back the resilient tab 33, i.e. pushes it towards the outside of the socket.

When the external force exerted on the plug to insert it into the socket is released, the resilient tab 33 pushes the plug in the opposite direction over a very short stroke until the free edge 36 of the spring blade comes to bear against the shoulder 4.

With the plug in this position, the head 24 of the stud 23 and the bulge 26 are pressed firmly against the corresponding conductive tracks of the printed circuit card under drive from the force applied on the plug by the resilient means 35.

Since the body of the plug is made of metal, the spring blade 35 establishes electrical contact between the ground braid of the coaxial cable and the ground tracks of the printed circuit via an electrical path that passes through the block 2, the spring blade 35, the socket 30, and the fixing flanges 32 of the socket.

This electrical contact is in addition to that already established by the bulge 26.

In a variant (not shown), the brass block 2 constituting the body of the plug can be replaced by a block of metal-plated plastics material.

Figure 3:
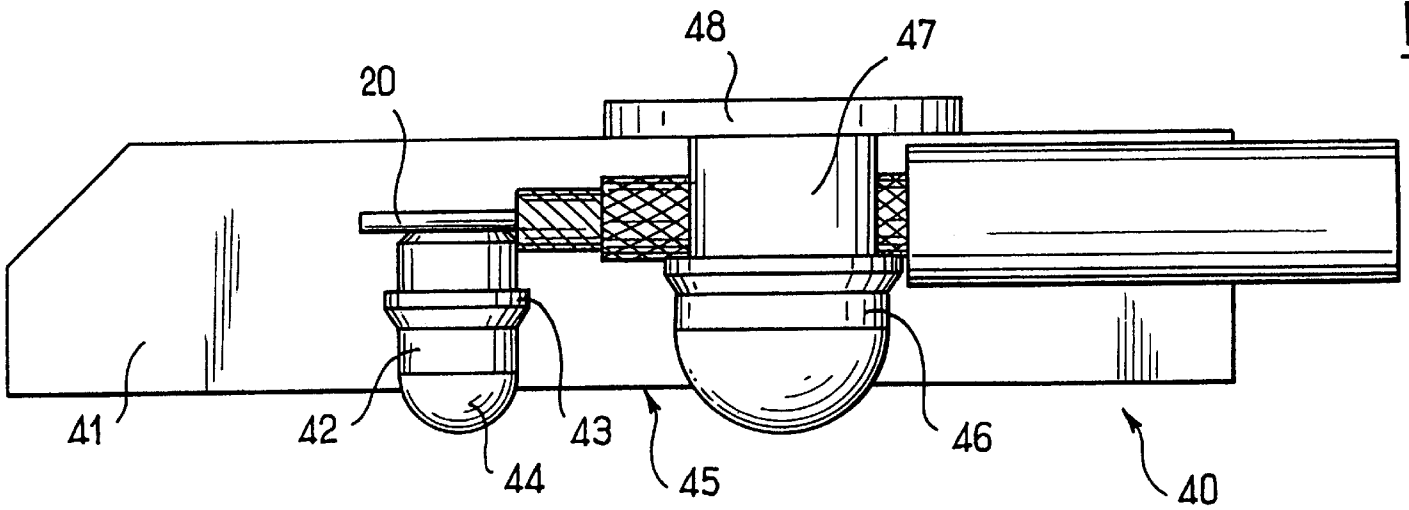
FIG. 3 is an axial section view of a plug constituting a second embodiment of the invention.

In the embodiment of FIG. 3, the plug 40 is made by overmolding a block 41 of plastics material on the end of a coaxial cable that has been stripped in the manner described above. This plug is designed to be inserted in a socket 30 that is similar to that shown in FIG. 1.

Prior to overmolding, the central conductor 20 of the cable is soldered to a stud-forming central contact 42 which is provided halfway up with a collar 43 whose function is to anchor said stud in the block of plastics material, and which is provided at its bottom end with a rounded head 44 or protuberance for projecting from the bottom face 45 of the block.

Similarly, prior to overmolding, the ground braid of the coaxial cable is soldered to the ground contact 46 that has the same shape as the central contact 42 but that is of dimensions that are larger.

The ground contact 46 which is soldered to the outer conductor 18 of the cable, is extended upwards by a metal portion 47 terminated by a flat 48 which is designed to project from the top face of the block 41 of overmolding plastics material.

The metal portion 47 can be used as a portion suitable for crimping on the braid 18 so as to avoid the need for soldering.

It can be seen that as in the above-described embodiment, the central contact 42 and the ground contact 46 project from the bearing face 45 of the plug.

In addition, a further electrical ground path is established via the socket by means of the flat 48 against which the spring blade 35 can bear when the plug is inserted in the socket.

Figure 4:
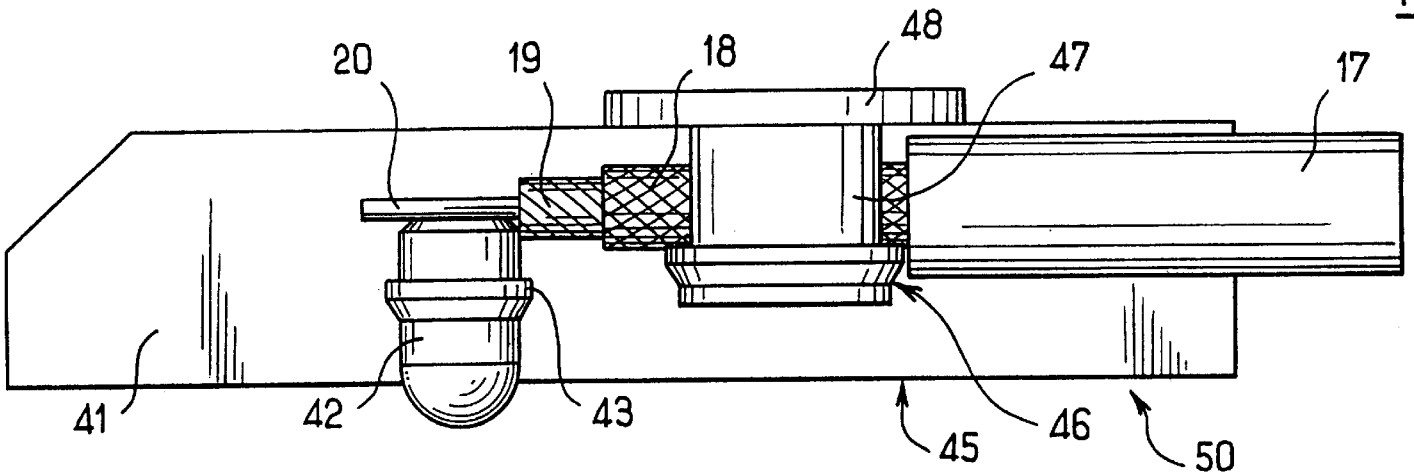
FIG. 4 is an axial section view of a plug constituting a third embodiment of the invention.

In the embodiment of FIG. 4, the plug 50 is similar to that of FIG. 3. It differs therefrom only in that its ground contact 46 does not have a rigid portion projecting from the bearing face 45 of the plug. The ground braid 18 of the coaxial cable is thus electrically connected only to the flat 48 which projects from the top face of the plug.

The braid of the coaxial cable is thus grounded solely via the socket 30 whose spring blade 35 bears against the ground flat 48.

Although this solution would appear, a priori, as being less reliable concerning grounding of the outer conductor of the cable, it turns out in practice to provide better electrical contact for the central contact on the corresponding track of the printed circuit card since the central contact is now the main bearing point between the plug and the card, such that when the coaxial cable is maneuvered, thereby tending to cause the plug to move, pivoting takes place around the central contact which nevertheless continues to press against the conductor track.

Figure 5:
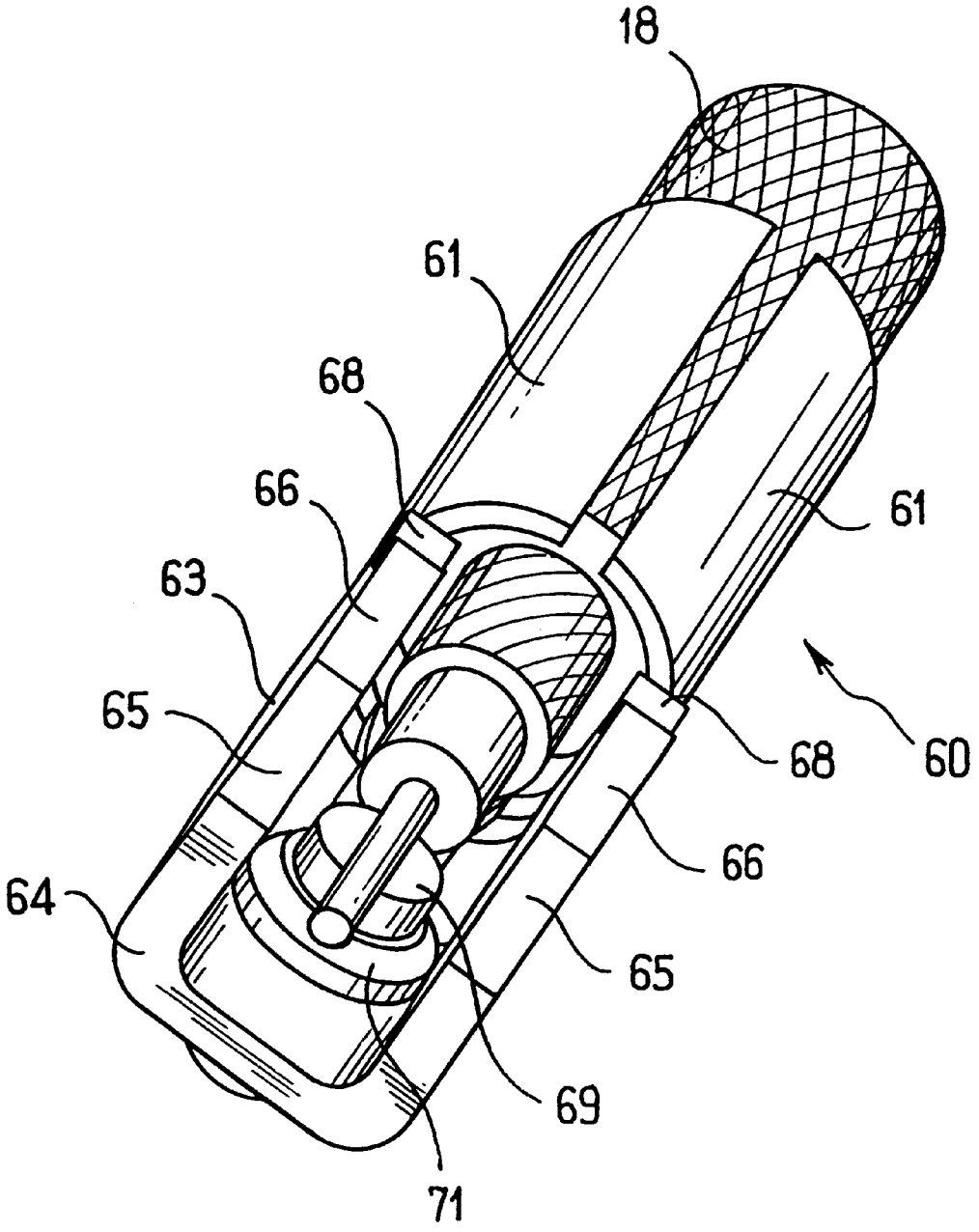
FIG. 5 is a perspective view from above of a plug constituting a fourth embodiment of the invention.
Figure 6:
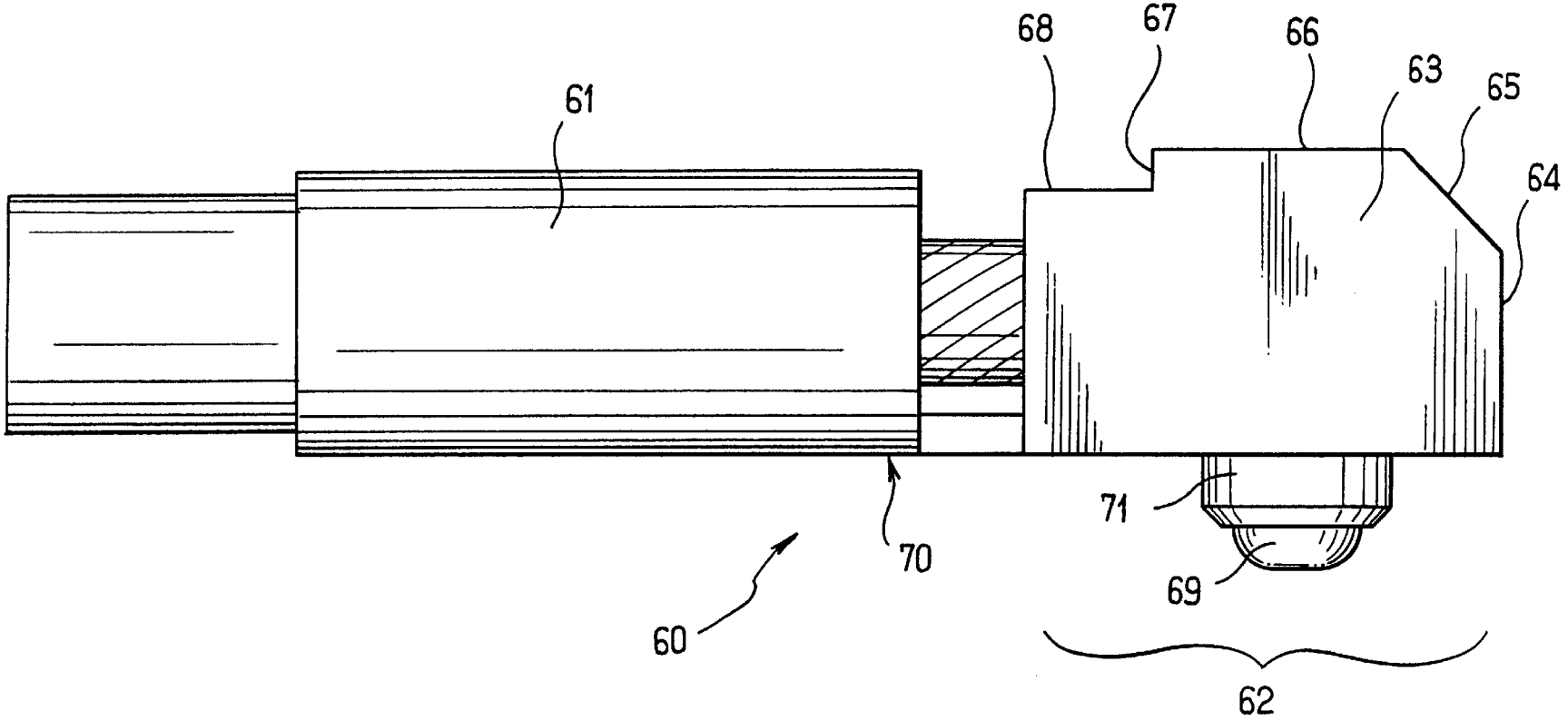
FIG. 6 is an elevation view of the left-hand side of the FIG. 5 plug.

In the embodiment of FIGS. 5 and 6, the body of the plug 60 is made by cutting out and rolling up a sheet of metal, however the plug is still designed to be inserted in the same socket 30 as before.

In its rear portion, the plug 60 has two rolled-up wings 61 which are crimped onto the ground braid 18 of the cable and thereafter enclosed said ground braid, thus simultaneously providing electrical connection between the ground braid and the body of the plug and also ensuring that the cable is securely retained in an axial direction.

For this purpose, the wings 61 can have internal ridges extending perpendicularly to the axis of the cable so as to penetrate into the braid and improve both electrical contact with the braid and mechanical retention of the cable as a whole.

The front portion of the plug is constituted by a channel section 62 whose raised flanges 63 present on their edges: a front face 64; chamfers 65; a high top face 66; a shoulder 67; and a low top face 68.

As in the first embodiment, the shoulder 67 between the high and low top faces enables the plug to be retained axially in the socket by the spring blade 35 which simultaneously serves to ground the body of the plug.

A stud 69 performs the central contact function by projecting through the bottom face 70 of the plug. This stud is insulated from the body of the plug by an annular dielectric 71 engaged in the web wall of the front portion 62 of the channel section of the plug.

Figure 7:
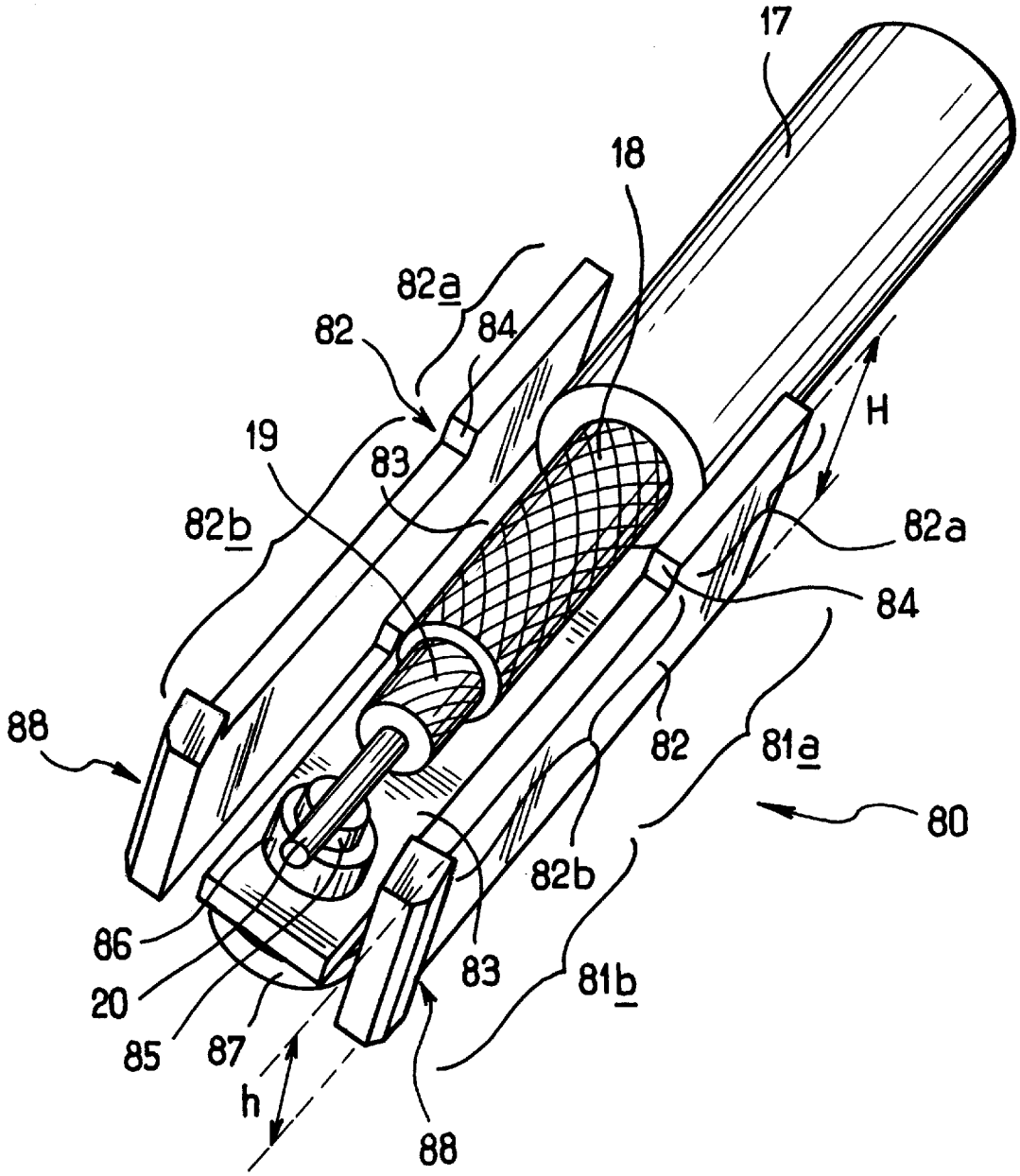
FIG. 7 is a perspective view from above of a plug constituting a fifth embodiment of the invention.
Figure 8:
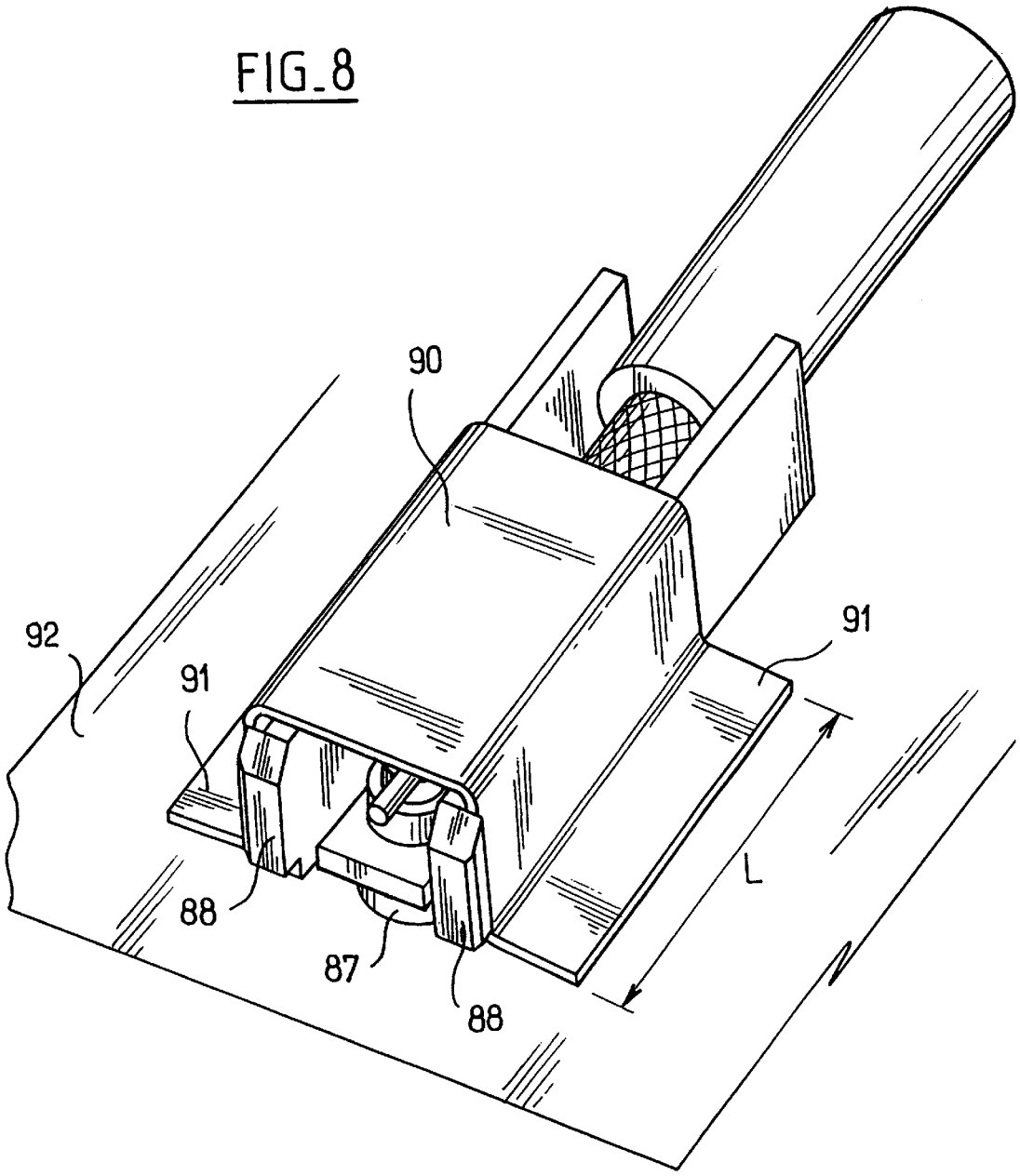
FIG. 8 is a view analogous to FIG. 7 showing the plug inserted in a corresponding socket.

The plug 80 of FIGS. 7 and 8 comprises a body made by folding a metal sheet.

The rear portion 81*a* of the plug body is of channel section having two flanges forming side flanks 82, and a bottom wall or web 83.

Each side flank 82 is of height H in its rear portion 82*a* and of height h smaller than H in its front portion 82*b*.

The rear and front portions 82*a* and 82*b* of the side flanks 82 are interconnected by a shoulder 84 of height H−h.

The side flanks 82 and the bottom wall 83 of the plug body extend in the front portion 81*b* of the plug body in individual manner, i.e. they are not connected together along the corners of the channel section of the plug body, since the bottom wall 82 is narrower in this front portion 81*b* of the plug body.

As a result, each of the bottom wall and the two side flanks presents a certain amount of resilience in a direction that is perpendicular to its own main plane, with the side flanks thus being capable of deforming sideways and the bottom wall being capable of deforming vertically.

In other words, in the front portion 81*b* of the plug body, the side flanks and the bottom wall constitute resilient beams.

In the vicinity of its free front end, the bottom wall 82 supports a central contact 85 in the form of a stud which is insulated from said bottom wall by an interposed tubular insulator 86.

The central conductor 20 of the coaxial cable is soldered to the stud 85;

The stud 85 has a rigid protuberance 87 beneath the bottom wall 83 projecting from the bottom wall of the plug. The height measured between the top edges of the front portions of the side flanks 82 and the protuberance 87 of the central contact 20 is considerably greater than the height h.

The outer conductor 18 of the cable is soldered directly to the bottom wall 83.

The free front end of each side flank or resilient beam 82 is provided with a rim 88 that extends outwardly and that forms a retaining catch.

Each rim 88 has a guide chamfer on its outer vertical edge and on its top horizontal edge.

The socket 90, which can be seen in FIG. 8, is a simple sheet of folded metal having two lateral flanges 81 for fixing to the printed circuit card 92 by being soldered to the surface thereof, and a body that is generally in the form of a rectilinear parallelepiped which is downwardly open and which is open at each end.

The length L of the socket is equal or very slightly shorter than the length of the front portions 82*b* of the side flanks 82 of the plug.

The plug is inserted into the socket via one of its ends. During this insertion, the chamfers on the rims 88 serve to center and to guide the plug.

Between the printed circuit card and the inside face of the top wall of the socket, the height left empty is equal to or slightly greater than the height h of the side flanks 82 in the front portions 82*b* thereof, but is less than the height H of the same side flanks 82 in their rear portions 82*a*.

The side flanks 82 bear against the inside face of the top wall of the socket, thereby pressing the plug against the printed circuit card.

Because the protuberance 87 of the central contact 20 projects from the bottom wall of the plug beyond the height available within the socket between the top edges of the side flanks and the printed circuit card, the bottom wall 83 is deformed upwards. Its stiffness gives rise to a force which presses the protuberance 87 of the central contact 85 against the printed circuit card.

The plug comes into position when the shoulders 84 of its side flanks come into abutment against the top wall of the socket.

When the plug is in its position, the rims 88 project beyond the end of the socket remote from the end in which the plug is inserted and the side flanks spread apart by resilient return, thereby snap-fastening the plug in the socket by means of the rims 88.

Electrical contact between the outer conductor of the cable and ground on the printed circuit card takes place via the socket, as described with reference to the preceding embodiment.

Figure 9:
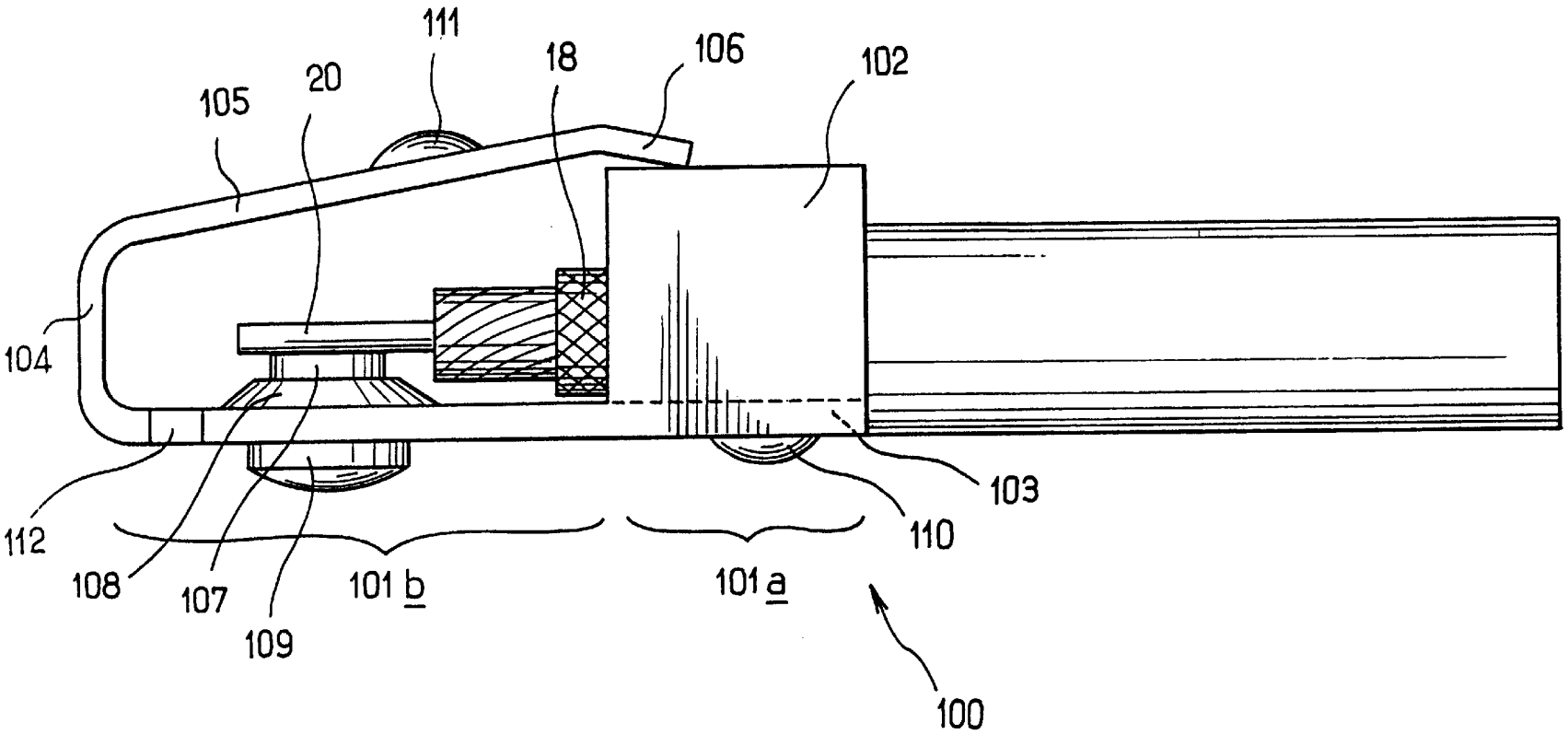
FIG. 9 is an elevation view showing the side of a plug constituting a sixth embodiment of the invention.
Figure 10:
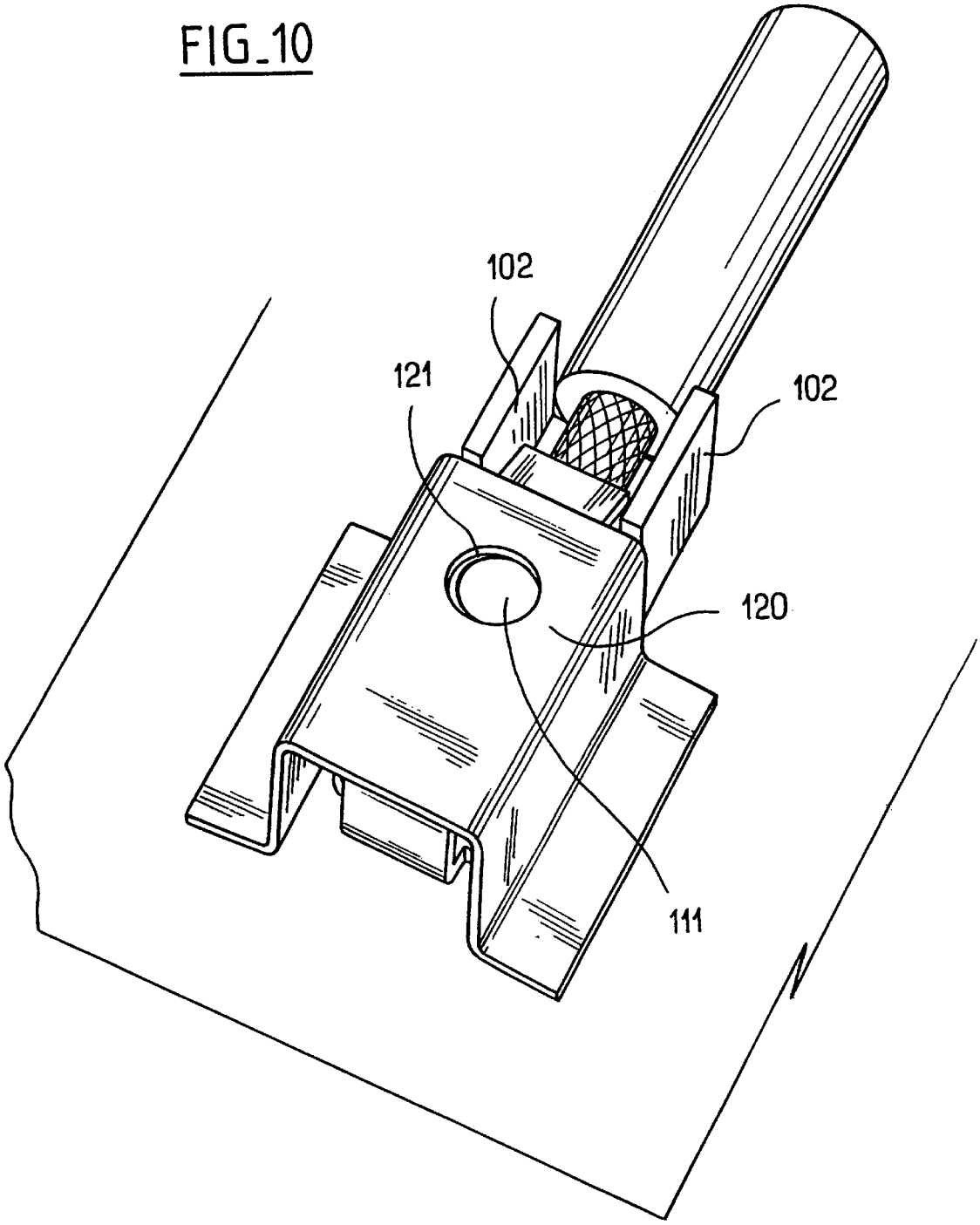
FIG. 10 is a perspective view from above of the FIG. 9 plug inserted in a corresponding socket.

In the embodiment of FIGS. 9 and 10, the plug 100 has a rear proton 101*a* that is of channel section having two lateral flanks 102 and a bottom wall 103.

The front portion 101*b* of the plug is constituted solely by the bottom wall 103 which extends to the front end of the plug where said bottom wall tapers in width via two chamfers 112 and is then extended by a vertical portion 104 followed by a resilient tongue 105 that is folded over rearwards, which resilient tongue replaces the spring blade.

The tongue 105 slopes forwards, i.e. going from front to rear it rises from a front height that is lower than that of the lateral flanks 102 to a rear height that is greater than that of said side flanks 102.

In its rear end portion, the tongue 105 terminates by a portion that slopes in the opposite direction and that is situated in the gap that extends between the two side flanks 102.

At the front of the plug, the bottom wall 103 supports a central contact 107 mounted with an interposed tubular insulator 108 and having a rigid protuberance 109 projecting from the bottom face of the plug body.

The central contact is soldered to the central conductor 20 of the coaxial cable whose outer conductor 18 is also soldered directly to the bottom wall 103 between the two side flanks 102.

The bottom wall 103 also has a bulge 110 projecting from the bottom face of the plug in its rear portion 101*a*, and a bulge 111 in its top portion that forms the resilient tongue 105.

The socket 120 is substantially identical to the socket 90 of the preceding embodiment, and it differs therefrom only by the fact that its top wall has a hole 121 for co-operating with the bulge 111 on the tongue 105.

Between the inside face of its top wall and the printed circuit card, the socket 120 leaves a space of height that is less than the height of the side flanks 102 and the rear height of the resilient tongue when at rest, but greater than the front height of the resilient tongue.

The plug is inserted into one of the open ends of the socket.

During such insertion, the chamfers 112 provide lateral centering for the plug, and the resilient tongue 105 acts as a chamfer providing centering in the vertical direction.

Under the effect of the plug insertion force, the tongue 105 deforms downwards so as to bear against the top wall of the socket.

Because of the stiffness of the tongue, the pressure exerted on the tongue is transferred to the central contact 107 whose protuberance 109 projecting from the bottom face of the plug is pressed against the printed circuit card.

When the side flanks 102 come into contact with the top wall of the socket, the bulge 111 penetrates into the hole 121 thus preventing the plug from being withdrawn from the socket.

For disconnection purposes, a force is exerted on the portion 106 of the tongue to push it down between the lateral flanks 102, thereby releasing the bulge 111 from the hole 121, and thus enabling the plug to be extracted by being moved in translation in the direction opposite to its insertion direction.

Electrical contact between the printed circuit card and the outer conductor of the cable takes place both via the bulge 111 and via the bulge 110 which bears directly against a corresponding conductor track on the printed circuit card.

Naturally, the embodiments described above are not limiting in any way and any desirable modifications can be made thereto without going beyond the ambit of the invention.

What is claimed is:

1. A device for connecting a coaxial cable to a printed circuit card, the device comprising:

a socket suitable for being fixed to the card;

a plug suitable for being mounted at the end of the coaxial cable having a central conductor, and comprising a central contact designed to be connected to said central conductor of the coaxial cable, and a bearing face via which said plug can press against the printed circuit card;

the socket and the plug being organized so that the plug can be inserted into the socket and can be retained by the socket with the bearing face of the plug pressed against the printed circuit card, the central contact of the plug thus being electrically connected to a conductor track of the printed circuit card;

wherein:

the central contact of the plug has a rigid protuberance having a hemispherical or rounded face projecting from the bearing face of said plug; and the device includes resilient means urging the hemispherical or rounded face towards the printed circuit card.

2. A device according to claim 1, wherein the resilient means is constituted by a spring blade which is carried by the plug or by the socket.

3. A device according to claim 1, wherein the socket is made by cutting and folding metal sheet.

4. A device according to claim 1, wherein the central contact of the plug is constituted by a metal insert retained in an insulator secured to the body of the plug.

5. A device according to claim 1, wherein the plug has a ground contact designed to be connected to the outer conductor of the cable.

6. A device according to claim 5, wherein the ground contact has a rigid portion projecting from the bearing face of the plug.

7. A device according to claim 1, wherein the socket has an electrically conductive body which is designed to be electrically connected to the ground tracks of the printed circuit card.

8. A device according to claim 7, wherein the plug and the socket are organized so that the outer conductor of the cable is electrically connected to the body of the socket when the plug is inserted in the socket.

9. A device according to claim 8, wherein the resilient means is constituted by a spring blade which is carried by the plug or by the socket, and wherein the spring blade is used as means for putting the body of the socket into contact with the outer conductor of the cable.

10. A device according to claim 1, wherein the body of the plug is constituted by a block of plastics material in which a housing is provided to receive the end of a coaxial cable.

11. A device according to claim 10, wherein the block of plastics material is covered in a layer of conductive material, which layer is designed to be electrically connected to the outer conductor of the cable.

12. A device according to claim 1, wherein the body of the plug is constituted by a metal block.

13. A device according to claim 1, wherein the body of the plug is made by cutting, folding, and/or rolling a sheet of metal.

14. A device according to claim 12, wherein the plug has a portion suitable for being crimped directly onto the outer conductor of the cable.

15. A device according to claim 13, wherein the body of the plug has an elastically deformable bottom wall suitable for being deformed in a direction that is perpendicular to the general plane of the printed circuit card, the central contact being mounted in said bottom wall.

16. A device according to claim 15, wherein the bottom wall is extended at the front of the plug by a resilient tongue that is folded over rearwards, and that bears against the socket when the plug is inserted in the socket.

* * * * *